United States Patent [19]

Ewing

[11] 4,449,168

[45] May 15, 1984

[54] QUICK INSTALL DEVICE FOR MOUNTING A LUMINAIRE

[75] Inventor: Robert L. Ewing, Newark, Ohio

[73] Assignee: Manville Service Corporation, Denver, Colo.

[21] Appl. No.: 311,833

[22] Filed: Oct. 16, 1981

[51] Int. Cl.[3] ..... F21S 1/04

[52] U.S. Cl. ..... 362/404; 362/147; 362/148; 362/368; 362/370; 362/396; 362/457

[58] Field of Search ..... 362/226, 368, 370, 404, 362/147, 148, 396, 457

[56] References Cited

U.S. PATENT DOCUMENTS

| | | | |
|---|---|---|---|
| 4,162,779 | 7/1979 | Van Steenhoven et al. | 362/404 X |
| 4,222,093 | 9/1980 | Garcia et al. | 362/368 X |
| 4,234,916 | 11/1980 | Goralnik | 362/368 X |
| 4,313,153 | 1/1982 | Davis | 362/147 X |
| 4,368,506 | 1/1983 | Rapp | 362/147 |

*Primary Examiner*—Stephen J. Lechert, Jr.
*Attorney, Agent, or Firm*—Cornelius P. Quinn

[57] ABSTRACT

A quick install device for mounting a luminaire on a flat surface such as a ceiling, a wall or the like, is disclosed. The device comprises in the preferred embodiment a mounting plate which is fixedly attached to an existing outlet box in the ceiling or wall and a luminaire plate which is fixedly attached to the luminaire. The luminaire plate and the mounting plate contain means for quickly attaching the two plates together with the attached plates serving as a splice chamber for containing the electrical splices used in electrically connecting the luminaire to an electrical circuit. The mounting plate structure and the luminaire plate structure may be reversed in actual use as desired by the purchaser of the device for different types of luminaire mountings.

6 Claims, 10 Drawing Figures

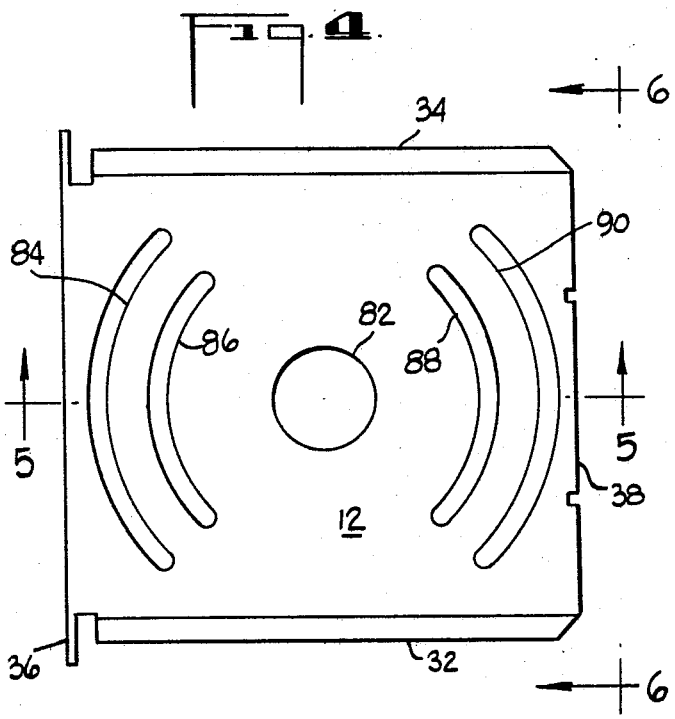
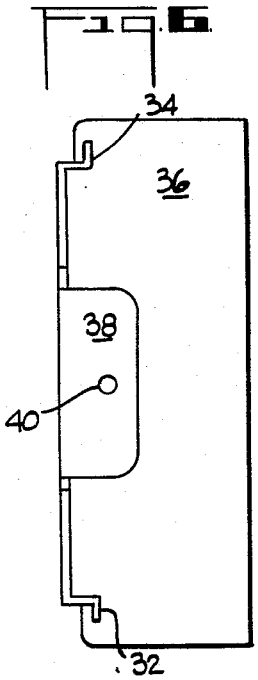
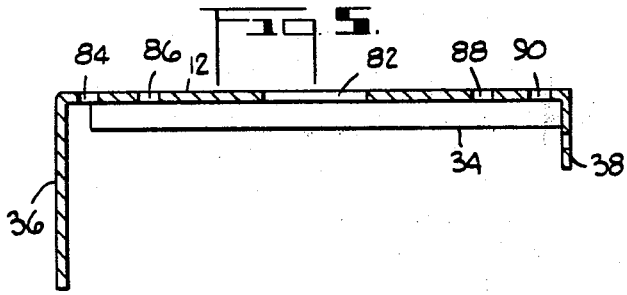
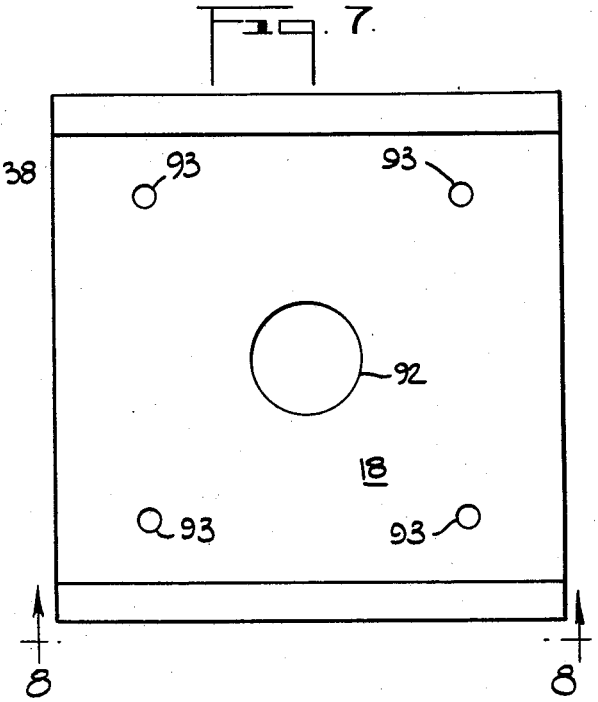
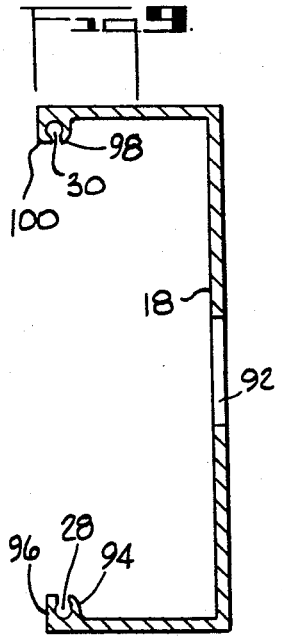
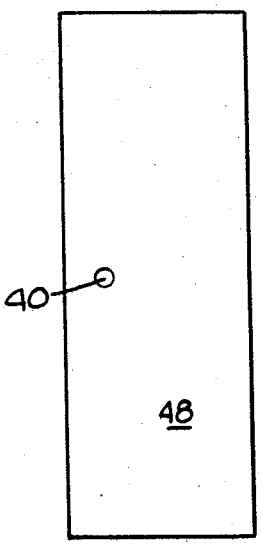
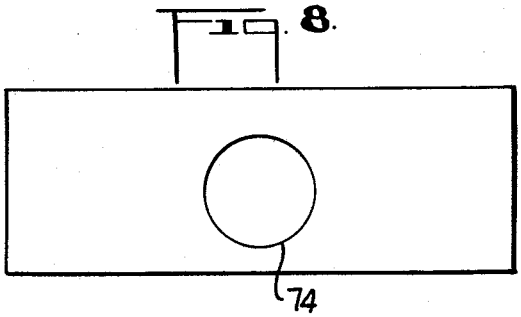
Fig. 10.

QUICK INSTALL DEVICE FOR MOUNTING A LUMINAIRE

BACKGROUND OF THE INVENTION

This invention relates generally to wall or ceiling mounted luminaires and more specifically relates to a quick install device for mounting the luminaire on a flat surface.

It is desirable in order to reduce installation time to be able to provide a luminaire which may be quickly installed at the job site without having to open the luminaire. It is also desirable to be able to provide for easier wiring of the luminaire and to be able to provide to the contractor the luminaire as an installed lamp ready for wiring. Previously known luminaires would be shipped to the contractor at a job site whereupon they would be opened by the electrician to expose the internal electrical wires which would then be attached to matching electrical wires in a previously installed outlet box. Thereupon, the luminaire would be fixedly attached to either the wall or ceiling by means known in the art such as toggle bolts, fastening screws, and other means. Such installation and mounting procedure can be lengthy and can result in excessive installation costs which must be passed on to the ultimate purchaser of the facility in which the luminaire is placed.

SUMMARY OF THE INVENTION

In order to overcome deficiencies in prior art lamp mounting structures, there has been provided by the subject invention a quick install device for mounting a luminaire on a flat surface such as a ceiling or a wall. The device consists of three basic parts along with a mounting screw. In the broadest form of the invention, a mounting plate is fixedly attached to the flat surface with a luminaire plate being fixedly attached to the luminaire as shipped from the factory. Means are provided on the respective plates for quickly attaching one plate to another and fixing the plates together by means of the attaching screw. The attached plates serve as a splice chamber for containing the electrical splices used for the luminaire. The mounting plate and the luminaire plate may be reversed in structure as an alternate to the invention where the lamp is to be surface mounted with surface conduit wiring. FIGS. 1 and 2 of the drawings illustrate the preferred embodiment of the invention and FIG. 3 represents an alternate of the invention whereby the mounting plate and the luminaire plate have been reversed on the respective mounting surfaces.

Accordingly, it is an object and advantage of the invention to provide a quick install device which is capable of mounting a luminaire on a flat surface such as a ceiling or a wall with the device consisting of three basic parts in addition to a mounting screw thereby allowing the lamp to be quickly mounted to the flat surface.

Another object and advantage of the invention is to provide a quick install device for a lamp which allows the lamp to be shipped from the manufacturer with a portion of the quick install device attached to thereby eliminate opening of the lamp at the job site in order to attach interiorly contained electrical wires.

Yet another object and advantage of the invention is to provide a quick install device for mounting a luminaire which forms a splice chamber with two of the basic parts of the Applicant's invention.

These and other objects and advantages of the invention will become apparent from a study of the drawings and from a review of the Description of the Preferred Embodiment.

BRIEF DESCRIPTION OF THE DRAWINGS

FIG. 4 is a plan view of the top of the basic mounting plate of the Applicant's invention;

FIG. 5 is a sectional view, taken along the line 5—5 of FIG. 4;

FIG. 6 is an end view, taken along line 6—6 of FIG. 4;

FIG. 7 is a plan view of the top of the luminaire plate of the Applicant's invention;

FIG. 8 is a side view, taken along line 8—8 of FIG. 7;

FIG. 9 is a sectional view, taken along line 9—9 of FIG. 7; and

FIG. 10 is an end view of the end cover plate of the Applicant's invention.

DESCRIPTION OF THE PREFERRED EMBODIMENT

Figure 1:
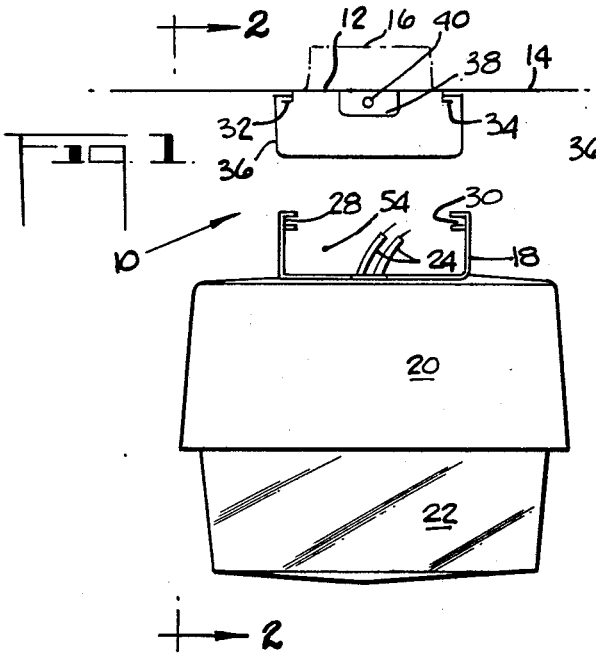
FIG. 1 is a side view of the Applicant's new and novel quick install device showing the luminaire plate mounted to the lamp and the mounting plate mounted on an existing outlet box in a ceiling installation.

Referring now to FIG. 1 of the drawing, there is shown a side view of the Applicant's new and novel quick install device which is shown generally by the numeral 10 and comprises a mounting plate 12 for fixedly attaching to a flat surface such as a ceiling 14 and to an existing outlet box 16 positioned and mounted above the ceiling 14. A luminaire plate 18 is fixedly attached to a luminaire 20 and is designed for mating engagement with the mounting plate 12 as will be described more fully hereinafter. The luminaire 20 contains a lens 22 and internal electrical lamps and parts necessary for lighting the lamp and also contains a plurality of exposed wires 24 which are designed for connection to matching wires 26 positioned in the outlet box 16 mounted above the ceiling 14. The matching wires 26 are shown in FIG. 2 of the drawing.

The luminaire plate 18 is formed in a generally U-shaped upstanding configuration and has formed on the end thereof a pair of inwardly facing slots 28 and 30 which are designed for engagement with a pair of downwardly depending legs 32 and 34 formed on the mounting plate 12. The mounting plate 12 is also formed in a generally U-shaped configuration and has formed thereon a long tab 36 and a short tab 38 formed on opposite sides of the mounting plate 12 as will be described more fully hereinafter. The short tab 38 also has formed in the central portion thereof a drilled and tapped hole 40 for receiving an attaching screw 42 shown in FIG. 2 of the drawing.

Figure 2:
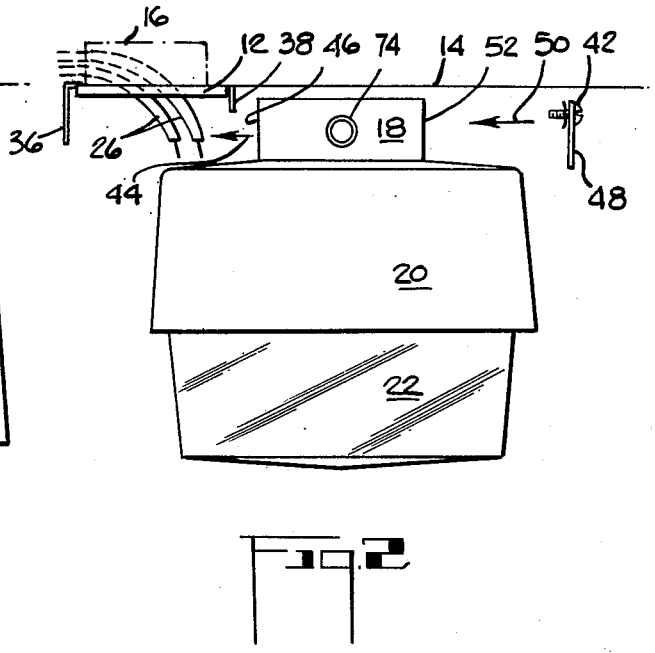
FIG. 2 is a side view, taken along line 2—2 of FIG. 1, showing the lamp of FIG. 1 being positioned on the mounting plate attached to the outlet box and further showing the end cover plate and attaching screw being positioned to fix the plates to each other.

Referring to FIG. 2 of the drawing, there is shown a side view taken along line 2—2 of FIG. 1 showing the luminaire 20 with its attached luminaire plate 18 about to be positioned on the mounting plate 12 so that the legs 32 and 34 of the mounting plate 12 will be engaged between the slots 28 and 30 of the luminaire plate 18. The direction of the positioning of the luminaire 20 onto the mounting plate 12 is shown by the arrow 44 in FIG. 2. The luminaire plate 18 is slid onto the mounting plate 12 until the end surface 46 is positioned against the long tab 36. The end cover 48 is then positioned in the direction shown by the arrow 50 to the end surface 52 of the luminaire plate 18. The end cover 48 is then adjacent to the short tab 38. Thereafter, the attaching screw 42 is positioned in the drilled and tapped hole 40 to quickly fix one plate to the other.

When the downwardly positioned U-shaped mounting plate 12 is attached to the upwardly positioned U-shaped luminaire plate 18 there is formed between the two U-shaped plates a splice chamber 54, shown in FIG. 1, into which the electrical splices may be positioned whenever the wires 24 are spliced to the wires 26 in order to electrically connect the luminaire 20 to its electrical source. For purposes of clarity the wires 24 and 26 have been shown short in length but in actual practice they would be sufficiently long to permit them to be spliced together before the luminaire plate 18 is slid onto the mounting plate 12.

Figure 3:
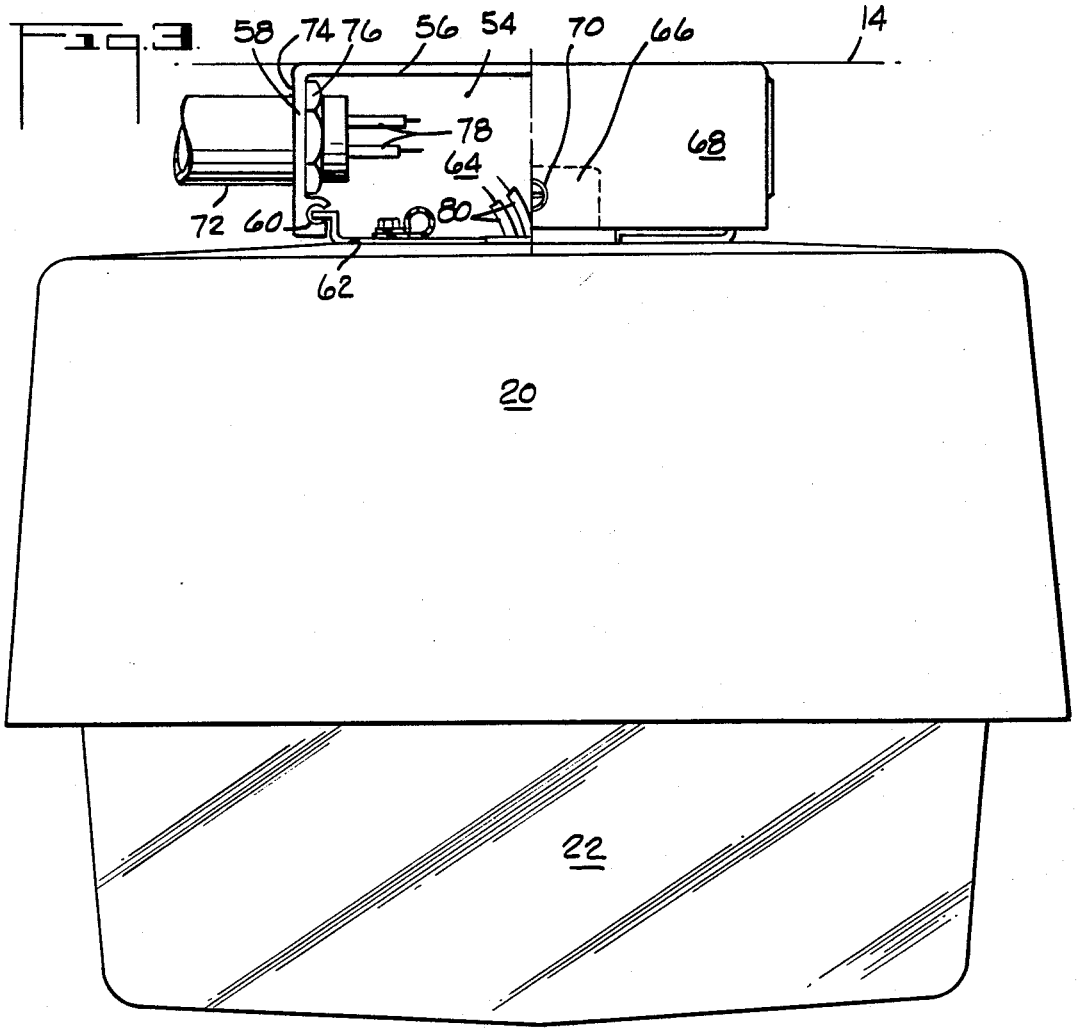
FIG. 3 is a side view of an alternate to the invention shown in FIGS. 1 and 2 showing the luminaire plate structure and the mounting plate structure being reversed with the luminaire plate structure being mounted on a ceiling installation and the mounting plate structure being mounted on the luminaire.

Referring now to FIG. 3 of the drawings, there is shown in a side view of the Applicant's invention a reversal of the mounting plate 12 and the luminaire plate 18 for use in a situation where it is desirous to have surface conduit wiring instead of hidden wiring above the ceiling 14. It can be seen in FIG. 3 how the structure of the mounting plate 12 and the luminaire plate 18 have been reversed so that the luminaire plate 18 becomes a mounting plate 56 in FIG. 3 having a pair of similar lengths oppositely spaced legs 58 and having formed thereon holding slots 60 as before-described. It can also be seen in FIG. 3 how the previously used mounting plate 12 of FIG. 1 has now been fixedly attached to the luminaire to form a luminaire plate 62 which is formed in the same generally U-shaped configuration and has formed thereon a long tab 64 and a short tab 66 shown dotted in FIG. 3. The same splice chamber 54 is formed by the mating engagement of the mounting plate and the luminaire plate as shown in FIG. 3 partially in section and partially as an end view to show the connection of the two parts. The end cover 68 is shown in the right side of FIG. 3 to thereby be able to show the attaching screw 70 positioned through the end cover and into the short tab 66 formed on the luminaire plate 62.

When the Applicant's device is positioned in the reversed manner as shown in FIG. 3, then it can be seen that an electrical conduit 72 would be positioned in a hole 74 formed on the side of the mounting plate 56 and would have a retaining nut 76 positioned thereon to fixedly attach the conduit 72 to the mounting plate 56. The electrical wires 78 positioned in the conduit 72 would have been previously spliced together by means known in the art and the connecting splices would then be positioned in the splice chamber 54 formed between the mounting plate 56 and luminaire plate 62.

It can be seen thusly then, that the basic quick install device comprises three basic parts in either the preferred embodiment or the alternate form of the embodiment with one basic part being the ceiling or wall mounting plate 12 or 56 and the second basic part being the luminaire plate 18 or 62. The third basic part designed to then form the splicing chamber is the end cover plate 48 or 68 which is attached to the splice chamber by means of the attaching screw 42 or 70. It can also be seen by referring to FIGS. 1 and 3 that basic mounting plate and luminaire plate may be reversed in their actual position as desired by the purchaser of the quick install device to thereby be able to provide exposed wiring or hidden wiring as desired by the electrical contractor.

Referring now to FIGS. 4, 5 and 6 of the drawing, there is shown in greater detail the mounting plate 12 of the Applicant's device which would be mounted on the ceiling or wall flat surface when used in the FIGS. 1 and 2 variation and would be mounted on the luminaire 20 when used in the FIG. 3 variation. The mounting plate 12 contains, in the central portion thereof, a hole 82 for receiving the plurality of electrical wires 26 in the FIGS. 1 and 2 variation and the electrical wires 80 in the FIG. 3 variation. The mounting plate also contains a series of arcuate slots 84, 86, 88 and 90 through which may be positioned a plurality of mounting fasteners when fastening the mounting plate to either the outlet box 16 or to a flat surface. The arcuate slots 84, 86, 88 and 90 then allow the mounting plate 12 to be rotated within the confines of the slots to a different position as desired by the installer.

Referring to FIG. 5, there is shown a sectional view, taken along line 5—5 of FIG. 4 showing how the mounting plate 12 would be constructed from a single sheet of 16 gauge steel and would have the long tab 36 and the short tab 38 formed by turning the ends of the steel plate downwardly to form the generally U-shaped configuration of the mounting plate. As has been beforementioned, the short tab 38 contains a drilled and tapped hole 40 for receiving the securing screw 42 or 70 depending upon which variation of the basic device is being utilized.

Referring to FIG. 6 of the drawing, there can be seen in greater detail an end view, taken along line 6—6 of FIG. 4 showing the legs 32 and 34 formed also out of the basic flat plate forming the structure of the mounting plate and formed in a turned down and turned out configuration to provide the necessary leg support which will engage the slots 28 and 30 on the mating luminaire plate 18.

Referring now to FIGS. 7, 8 and 9 of the drawing, there is shown in greater detail the luminaire plate 18 which would be formed preferably from an aluminum extrusion alloy and would be formed in the one-piece construction shown in these figures. The luminaire plate 18 contains in the central portion thereof a hole 92 for receiving the plurality of electrical wires 26 or 80 depending upon which modification of the embodiment is used. The luminaire plat 18 also contains a plurality of holes 93 for mounting the plate on an adjacent surface. The luminaire plate 18 contains in the central portion of one side thereof, as shown in FIG. 8, a hole 74 for receiving a plurality of electrical wires 78 as shown in FIG. 3 of the drawing when used with surface conduit wiring. The hole 74 would be plugged with a snap-in plug before being painted whenever the luminaire plate 18 was used for ceiling or wall mounting as shown in FIGS. 1 and 2 of the drawing. There is also shown in FIG. 9 of the drawing in greater detail how the slots 28 and 30 formed on the upper portion of the generally U-shaped luminaire plate 18 are formed by a plurality of protruding fingers 94, 96, 98 and 100, with the fingers forming the slots 28 and 30 designed to receive the outwardly turned legs 32 and 34 formed on the mounting plate 12.

Referring now to FIG. 10 of the drawing, there is shown the end cover formed in a generally rectangular configuration and having formed therein the hole 40 designed to receive the attaching screw 42 or 70. The cover plate would be formed preferably of 18 gauge steel which would be painted to match the printing on the mounting plate 12 as well as the luminaire plate 18.

From the foregoing, it can be seen that there has been provided by the subject invention a new and novel quick install device for mounting a luminaire on a flat surface such as a ceiling or wall with the device being capable of being reversed so that either exposed wiring or hidden wiring may be used. The device comprises three basic parts with an attaching screw to form a interior splice chamber into which connecting electrical wiring may be positioned. Nevertheless, it should be apparent from a review of the drawings and study of the specification that other changes may be made in the basic device without departing from the spirit and scope of the invention and the invention is not to be limited to the exact structure shown and described which has been given by way of illustration only.

Having described my invention, I claim:

1. A light fixture assembly for mounting a luminaire on a flat surface such as a ceiling, a wall or the like, comprising:

(a) a mounting plate for fixedly attaching to the flat surface:

(b) a luminaire plate for fixedly attaching to the luminaire;

(c) a pair of horizontally longitudinally elongated holding legs fixedly attached to one of the plates and horizontally longitudinally elongated mating holding slots fixedly attached to the other plate for horizontally slidably engaging the plates together and attaching means for fixing one plate to the other plate; and (d) a splice chamber for containing electrical splices used for the luminaire formed between the attached plates.

2. A light fixture assembly as defined in claim 1 wherein the attaching means comprises a short tab formed on one of the plates and a cover plate fixedly attached to the short tab for holding the plates together.

3. A light fixture assembly as defined in claim 1 wherein the mounting plate is formed in a generally U-shaped configuration and has formed thereon a long tab and a short tab.

4. A light fixture assembly as defined in claim 3 wherein the pair of horizontally longitudinally elongated oppositely spaced holding slots are formed on the luminaire plate and the pair of horizontally longitudinally elongated holding legs are formed on the mounting plate for slidable mating engagement with the holding slots.

5. A light fixture assembly as defined in claim 4 further comprising a cover plate, the cover plate further being fixedly attached to the short tab and enclosing one end of the plates with the long tab enclosing the other end of the plates.

6. A light fixture assembly as defined in claim 5 wherein the mounting plate has a hole formed therein for receiving a plurality of electrical wires.

* * * * *